US007454264B2

(12) United States Patent
Schaeffer

(10) Patent No.: US 7,454,264 B2
(45) Date of Patent: Nov. 18, 2008

(54) METHOD OF BEVELING AN OPHTHALMIC LENS BLANK, MACHINE PROGRAMMED THEREFOR, AND COMPUTER PROGRAM

(76) Inventor: Kurt William Schaeffer, 927 Oak Ave., Waynesboro, VA (US) 22980

( * ) Notice: Subject to any disclaimer, the term of this patent is extended or adjusted under 35 U.S.C. 154(b) by 9 days.

(21) Appl. No.: 11/605,222

(22) Filed: Nov. 29, 2006

(65) Prior Publication Data

US 2008/0125013 A1 May 29, 2008

(51) Int. Cl.

| | |
|---|---|
| ***G06F 19/00*** | (2006.01) |
| ***B24B 51/00*** | (2006.01) |
| ***B24B 1/00*** | (2006.01) |
| ***G02C 7/00*** | (2006.01) |

(52) U.S. Cl. ..... 700/164; 700/172; 700/182; 451/5; 451/43; 351/177

(58) Field of Classification Search ..... 700/160, 700/164, 172, 182–184, 186; 451/5, 42–44, 451/126, 240, 263; 351/159, 177
See application file for complete search history.

(56) References Cited

U.S. PATENT DOCUMENTS

| | | | | |
|---|---|---|---|---|
| 6,099,383 | A * | 8/2000 | Mizuno et al. | 451/5 |
| 6,203,409 | B1 | 3/2001 | Kennedy et al. | |
| 6,547,642 | B2 * | 4/2003 | Hatano | 451/11 |
| 6,623,339 | B1 * | 9/2003 | Igarashi et al. | 451/42 |
| 6,751,522 | B2 * | 6/2004 | Okada et al. | 700/164 |
| 2006/0083596 | A1 | 4/2006 | Gerding | |

FOREIGN PATENT DOCUMENTS

| | | |
|---|---|---|
| WO | WO 95/00292 | 1/1995 |

* cited by examiner

*Primary Examiner*—Sean P Shechtman
(74) *Attorney, Agent, or Firm*—Berenato, White & Stavish

(57) ABSTRACT

The present invention is directed to a machine programmed to edge an ophthalmic lens blank. The machine includes an edger device for forming a bevel in a peripheral edge of the lens blank, a central processing unit operably associated with the edger device for controlling operation thereof, and a computer program stored on a medium in communication with the central processing unit. The computer program includes a first instruction set operably causing the edger device to form a bevel in a peripheral edge of a lens blank. A second instruction set operably causes the edger device to form a step in the peripheral edge intermediate an apex of the bevel and an interface between the peripheral edge and a major surface of the lens blank. A method of controlling an edger device for edging an ophthalmic lens blank and a computer program are also disclosed.

24 Claims, 4 Drawing Sheets

METHOD OF BEVELING AN OPHTHALMIC LENS BLANK, MACHINE PROGRAMMED THEREFOR, AND COMPUTER PROGRAM

COMPUTER PROGRAM LISTING APPENDIX

A computer program listing appendix is submitted herewith on compact disc recordable (CD-R) as Appendix A, and the material thereon is incorporated herein by reference. Duplicate copies of Appendix A are provided as Copy 1 and Copy 2. Copy 1 and Copy 2 are identical.

The files contained on Copies 1 and 2 are as follows:

| File Name: | Size in Bytes: | Date of CD Creation: |
|---|---|---|
| BeveledShelf | 3,677 | 14 Nov. 2006 |

FIELD OF THE INVENTION

The present invention is directed to a machine programmed to edge an ophthalmic lens blank. The machine includes an edger device for forming a bevel in a peripheral edge of the lens blank, a central processing unit operably associated with the edger device for controlling operation thereof, and a computer program stored on a medium in communication with the central processing unit. The computer program includes a first instruction set operably causing the edger device to form a bevel in a peripheral edge of a lens blank. A second instruction set operably causes the edger device to form a step in the peripheral edge intermediate an apex of the bevel and an interface between the peripheral edge and a major surface of the lens blank. A method of controlling an edger device for edging an ophthalmic lens blank and a computer program are also disclosed.

BACKGROUND OF THE INVENTION

Prescription eyeglass lenses are curved in such a way that light is correctly focused onto the retina of a patient's eye, improving vision. Such lenses are formed from glass or plastic lens "blanks" having certain desired properties to provide the correct prescription for the patient. The blanks are usually circular and of substantially larger dimension compared to the relatively smaller finished lenses assembled into eyeglass frames. Therefore, a lens blank must be edged to fit an eyeglass frame selected by the patient.

Ophthalmic laboratory technicians cut, grind, edge, and polish blanks according to prescriptions provided by dispensing opticians, optometrists, or ophthalmologists. The specifications include the patient's full prescription, including: 1) the total power the finished lens must have; 2) the strength and size of any segments, if needed (i.e. multifocal lenses); 3) the power and orientation of any cylinder curves; and 4) the location of the optical center and any inducted prism that may be needed.

In addition, the large diameter blank is sized and shaped to fit into the frame selected by the patient. The lens blank may be shaped using an edger, such as the edger disclosed in U.S. Pat. No. 6,203,409 to Kennedy et al., the disclosure of which is incorporated herein by reference. The blank is edged so that the periphery of the finished lenses fit into the openings on the frames.

Edging of a lens blank typically requires the application of a block to a surface thereof. The block is releasably secured to a clamp assembly, so that rotation of the clamp assembly causes corresponding rotation of the lens blank. As the blank is rotated, the periphery of the blank may be cut to a desired size using a router tool. The blank may be either ground or cut. Wet edgers use diamond-impregnated wheels with different abrasive grits to grind the lens material. A coolant is sprayed on the wheels during edging to reduce heat. Dry edgers use carbide steel or diamond blades mounted on the spindle of a motor to shave the lens. The lens periphery may also be polished using a polishing tool. Some edgers are also able to form a bevel about the periphery of the lens.

Information relating to the size and shape of the lens needed for a particular frame (i.e. trace data) may be generated, and subsequently transmitted to the edger. Such trace data may be provided by frame manufacturers, or generated by a tracer machine. Trace data may be downloaded and/or transmitted to a storage medium in a control system, such as a central processing unit, in communication with the edger.

The edger processes the edge of the lens blank to create an edge profile according to the trace data. The finished lens may then be assembled with the selected eyeglass frames. Many frames have a groove extending around the inner circumference of the openings. The groove interlocks with a complementarily shaped bevel formed about the peripheral edge of the lens. The interlock between the complementary groove and bevel helps to secure the lens within the frame opening.

Many of today's frames have a relatively 'high wrap', such as frames having a curvature greater than 6 diopters. Typically, though not necessarily, high wrap is provided so that the eyeglass frame more closely follows the contour of the wearer's face. It is often difficult to insert a beveled lens into the corresponding groove in a high wrap frame because the edge of the lens adjacent the formed bevel interferes with the portion of the frame adjacent the groove. The lens bevel may not properly rest within the frame groove, particularly when inserting relatively thick lenses into high wrap frames. The result is a poor fit between the lenses and frames.

SUMMARY OF THE INVENTION

The present invention relates to a method of controlling an edger device for edging an ophthalmic lens blank. A lens blank having first and second opposite major surfaces and a peripheral edge therebetween is provided. An edger device having a cutting mechanism for forming a bevel in the peripheral edge is provided. A central processing unit operably associated with the edger device for controlling operation of the cutting mechanism is provided. Processing instructions are transmitted from the central processing unit to the edger device. The processing instructions comprise: a) forming a bevel in a peripheral edge of a lens blank, the bevel having an apex extending outwardly from the peripheral edge; and b) forming a step in the peripheral edge intermediate the apex and an interface between the peripheral edge and the second major surface.

The present invention also relates to a machine programmed to edge a lens blank. The machine includes an edger device for forming a bevel in a peripheral edge of a lens blank, a central processing unit operably associated with the edger device for controlling operation of the edger device, and a computer program stored on a medium in communication with the central processing unit. The computer program includes a first instruction set operably causing the edger device to form a bevel in a peripheral edge of a lens blank. The bevel has an apex extending outwardly from the peripheral edge. A second instruction set operably causes the edger device to form a step in the peripheral edge intermediate the apex and an interface between the peripheral edge and a major surface of the lens blank.

A computer program stored on a medium for use in an edging process employing a lens blank and an edger device is disclosed. The computer program includes a first set of computer instructions operably recalling trace data about a lens blank to be processed. The lens blank has first and second opposite major surfaces and a peripheral edge therebetween. A second set of computer instructions operably causes an edger device to form a bevel in the peripheral edge of the lens blank at a selected position defined by and relative to the trace data. The bevel has an apex extending outwardly from the peripheral edge. A third set of computer instructions operably causes the edger device to form a step in the peripheral edge intermediate the apex and an interface between the peripheral edge and the second major surface.

DETAILED DESCRIPTION OF THE INVENTION

Figure 1:
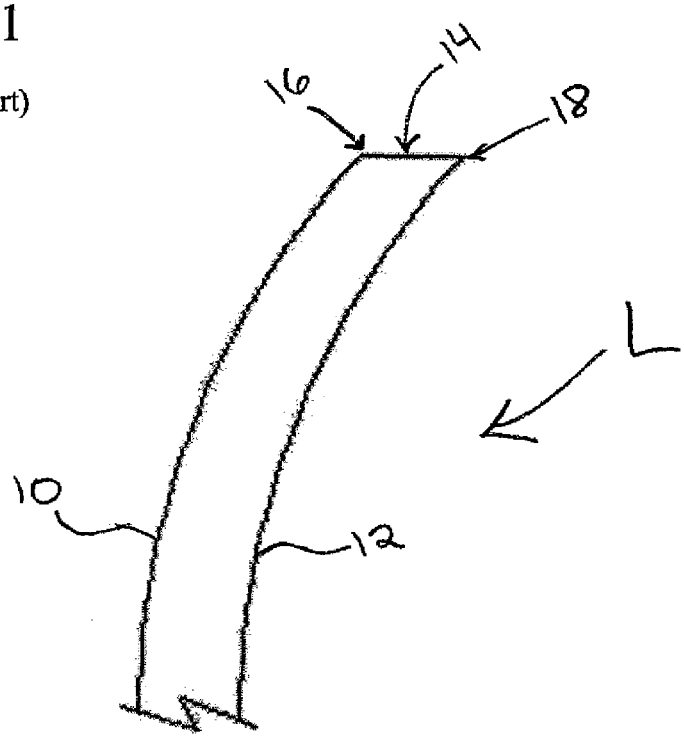
Fig. 1 (Prior Art)
FIG. 1 is a fragmentary sectional view of an ophthalmic lens blank prior to edging.

The present invention is directed to a machine programmed to edge a lens blank. As known in the art, a lens blank may be ground to fit a particular eyeglass frame. As best shown in FIG. 1, a lens blank L includes first and second opposite major surfaces 10, 12, and a peripheral edge 14 therebetween. The boundary between first major surface 10 and peripheral edge 14 defines a first interface 16. The boundary between second major surface 12 and peripheral edge 14 defines a second interface 18.

Figure 2:
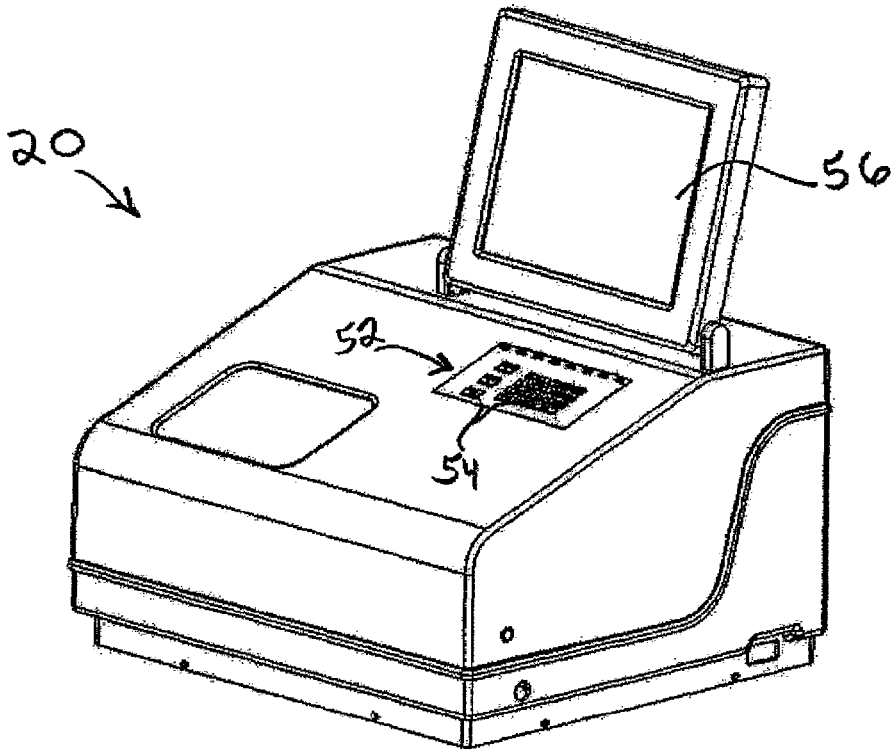
FIG. 2 is a perspective view of an edger device for use in an edging process according to the present invention.
Figure 3:
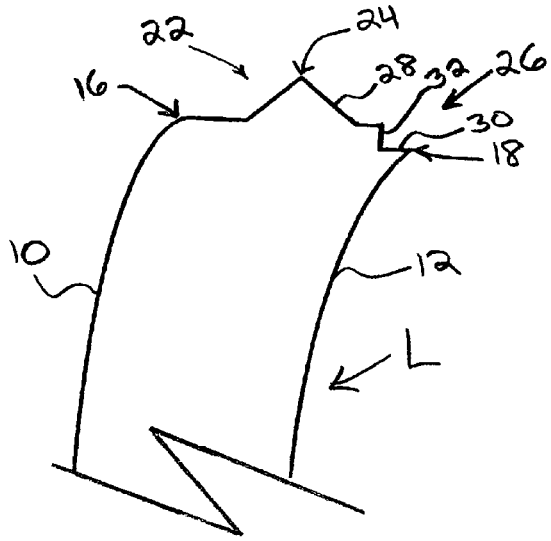
FIG. 3 is a fragmentary sectional view of an ophthalmic lens blank having a bevel and a step formed in the peripheral edge according to a first configuration.
Figure 4:
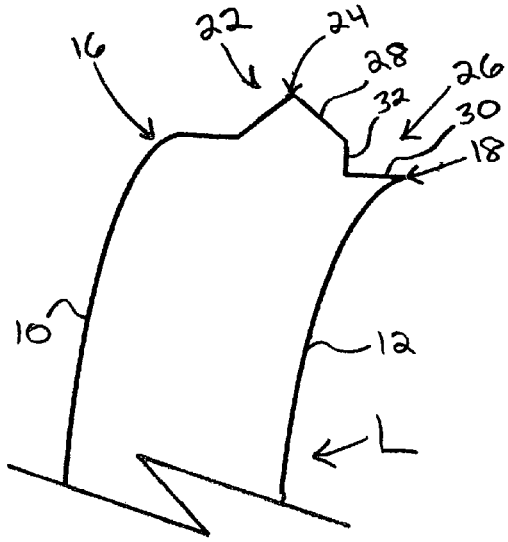
FIG. 4 is a fragmentary sectional view of an ophthalmic lens blank having a bevel and a step formed in the peripheral edge according to another configuration.

As best shown in FIG. 2, an automated edger device 20 may be used to grind peripheral edge 14 of lens blank L to a desired size and shape. Suitable edger devices are available from National Optronics of Charlottesville, Va., such as the 7E Patternless Edger machine. Edger device 20 is programmed to form an outwardly extending bevel 22 having an apex 24 in peripheral edge 14 of lens blank L, and a step 26 intermediate apex 24 and interface 18, as best shown in FIGS. 3 and 4. Note that lens material is removed during the edging process. Therefore, the lens material forming interfaces 16, 18 prior to edging, as shown in FIG. 1, may be removed during the edging process. However, the resulting boundary between first and second major surfaces 10, 12 and the edged peripheral edge 14 is still defined herein by interfaces 16, 18, as shown in FIGS. 3 and 4. Step 26 may be formed proximate and spaced from a sidewall 28 of bevel 22, as best shown in FIG. 3. Alternatively, a portion of sidewall 28 may be removed when forming step 26, as best shown in FIG. 4. The resulting step 26 includes a base 30 and back wall 32. Back wall 32 is preferably substantially perpendicular to base 30, though back wall 32 may also be angularly disposed relative to base 30.

Figure 5:
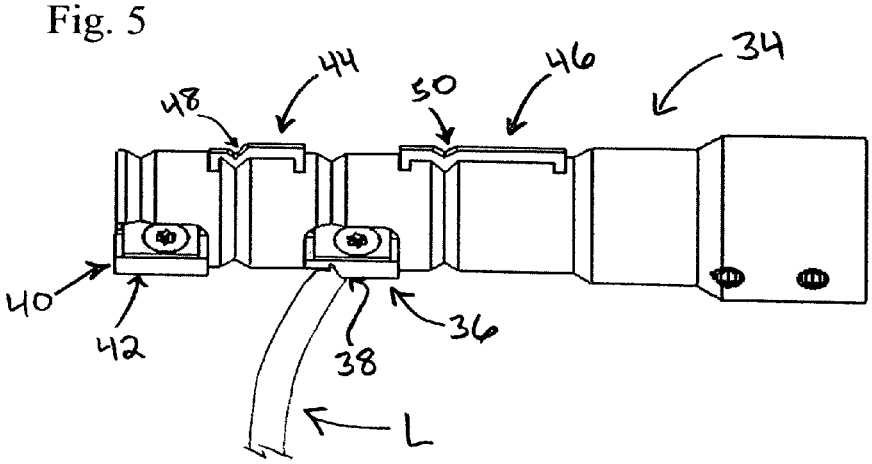
FIG. 5 is an elevational view of a router tool for use in an edging process according to the present invention, and a fragmentary sectional view of an ophthalmic lens blank being edged using a first blade.
Figure 6:
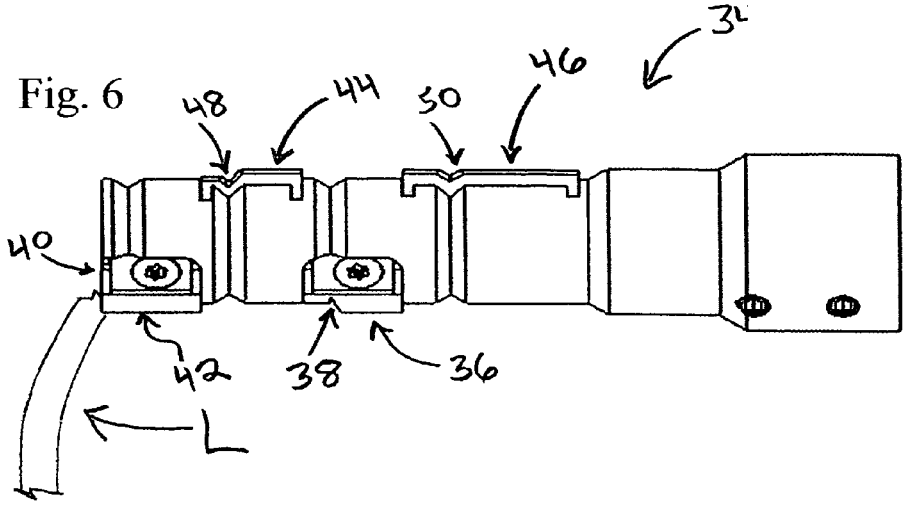
FIG. 6 is an elevational view of the router tool of FIG. 5, and a fragmentary sectional view of the ophthalmic lens blank being edged using a second blade.

Edger device 20 preferably includes a cutting mechanism, such as a router tool 34, for processing the lens blank, as best shown in FIGS. 5 and 6. A suitable router tool is described in U.S. Patent Publication No. 2006/0083596, the disclosure of which is incorporated herein by reference. Router tool 34 preferably includes a first blade 36 having a profiled cutting portion 38 for forming bevel 22, and a second blade 40 having a planar cutting portion 42 for forming step 26. Router tool 34 may also include additional blades, such as blades 44, 46, having differently configured cutting portions 48, 50 for forming bevels 22 having different profiles.

It should be understood that various cutting mechanism may be used with the present invention. Router 34 shown in FIGS. 5 and 6 is exemplary only, and the invention is not so limited. Thus, any cutting mechanism that is capable of cutting or grinding a lens blank at the appropriate angles may be used. For example, a cutter tool may be provided having a blade which includes a profiled cutting portion for forming the bevel, and a planar cutting portion for forming the shelf.

A central processing unit, or "CPU", (not shown) is provided, preferably as an internal component of edger device 20. However, the CPU may also be external to edger device 20. The CPU is operably associated with edger device 20 and controls operation thereof. The CPU includes a storage medium. A computer program is stored on the medium and in communication with the CPU. The computer program includes a set of processing instructions for controlling operation of edger device 20. The CPU transmits the processing instructions to edger device 20, thereby controlling the edging process according to specified processing steps.

A technician may select processing parameters based on trace data for a particular lens blank L to be processed. Trace data is input to the CPU to ensure proper formation of bevel 22 and step 26. The input or downloaded trace data preferably includes the horizontal or A-dimension of the frame, the vertical or B-dimension of the frame, lens base curve, frame wrap, and other data relating to the optical and geometrical parameters of the finished lens. The smallest rectangle which encloses or 'boxes' the lens mount shape using horizontal and vertical lines is known as the 'boxing system'. The horizontal or A-dimension is defined as the distance between the two vertical sides of the box. The A-dimension measures the distance between vertical tangents to the bevel of a lens. The distance between the top and bottom of the box is the vertical or B-dimension. The B-dimension measures the distance between horizontal tangents to the bevel of the finished lens. The trace data defines the three-dimensional shape of peripheral edge 14 of lens blank L.

Figure 7:
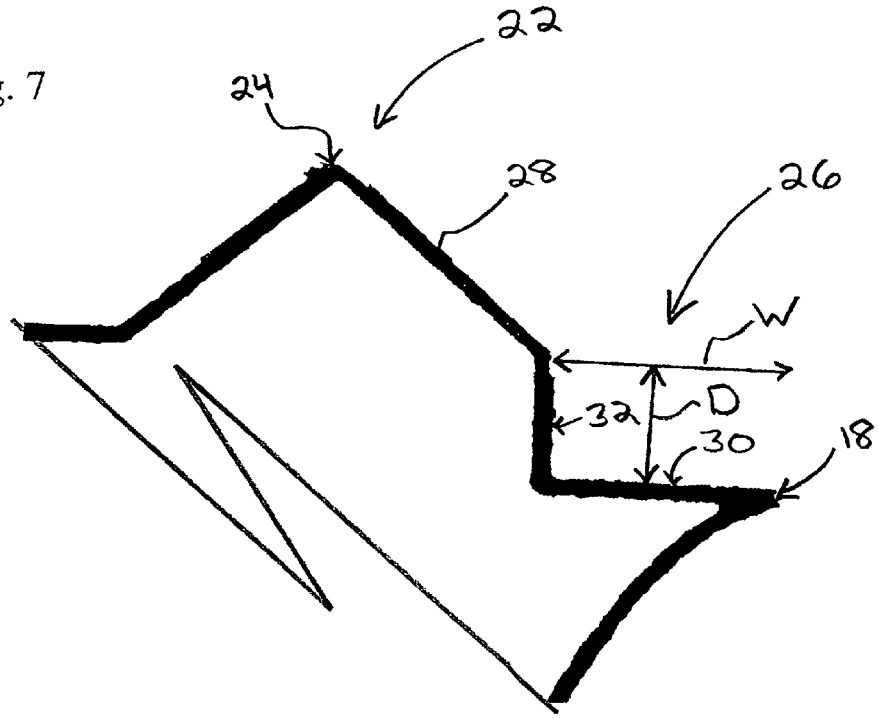
FIG. 7 is an exploded fragmentary sectional view of the ophthalmic lens blank of FIG. 4.

As shown in FIG. 2, edger device 20 preferably includes a control panel 52 mounted to an upper portion of edger device 20 and provides access by the technician to various controls, collectively 54. Processing parameters may be input into edger device 20 via controls 54, including the position and profile of bevel 22, and the width and depth of step 26 in peripheral edge 14. The width of step 26 is defined by the width of base 30, shown by arrow 'W' in FIG. 7. The depth of step 26 is defined by the height of back wall 32, shown by arrow 'D' in FIG. 7.

Controls 54 may be provided as a touch screen including a plurality of touch keys and input fields displayed thereon. Alternatively, a conventional keypad or other input device may be provided. Alternatively, an external input device operably associated with edger 20 may be provided, such as a tablet or keypad. Edger device 20 may also include a display 56 for displaying input fields, trace data, and other information corresponding to the selected processing parameters. As shown in FIG. 2, display screen 56 is an LCD display screen mounted on an upper portion of edger device 20. Alternatively, an external display operably associated with edger device 20 may be provided.

In addition to processing parameters relating to bevel 22 and step 26, other processing parameters may be selected by the technician, such as wet and/or dry polishing, drill holes, etc. For example, the touch screen may include an input field for "bevel profile" with the technician prompted to an input field in which various profiles may be selected. The position of bevel 22 may also be selected by the technician via an associated input field and input via controls 54. With respect to processing parameters for step 26, an input field may be provided wherein the technician specifies its position relative to apex 24 and interface 18. Step 26 may be formed in only a portion of peripheral edge 14 about the periphery of lens blank L. In addition, step 26 may be formed to have a variable width W and/or variable depth D around peripheral edge 14. Input fields relating to aspects of bevel 22 and step 26 may be displayed on display 56.

While trace data may be manually entered via controls 54, such data may also be downloaded to the CPU via an associated serial port, particularly if such data is electronically available from the frame manufacturer. Such data is sometimes accessible by the frame manufacturer's model number and size information, and may be easily downloaded to the CPU. Trace data may be stored on the associated storage medium and recalled by the CPU when needed. Accordingly, the technician may request particular stored or downloaded trace data via an associated input field with controls 54.

Figure 8:
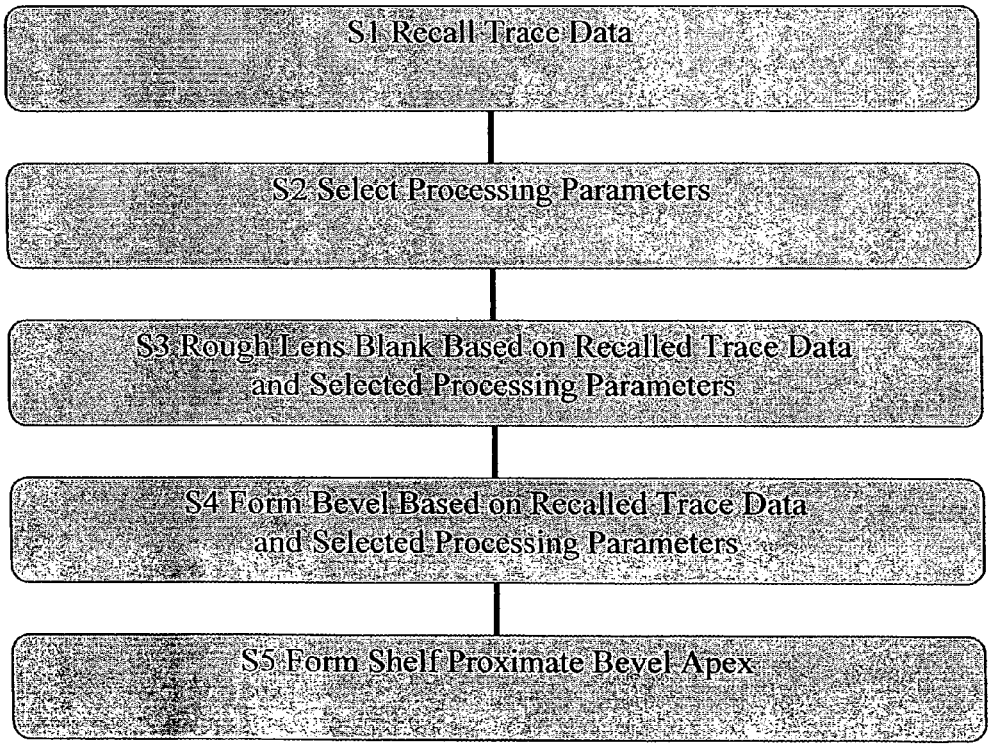
FIG. 8 is a chart showing processing steps for an edging process according to the present invention.

Processing instructions for controlling edger device 20 will be described with reference to FIG. 8. First, the CPU recalls trace data usable by edger device 20 and corresponding to particular frames at S1. Trace data typically includes a list of points that define the shape of the lens and matching frame. Such points may be relative to a geometric or optical center of lens blank L. Trace data is typically available from the frame manufacturer, and may be downloaded to the CPU via an associated serial port. Alternatively, trace data may be input by the technician using controls 54. The trace data is preferably stored on an associated storage medium in communication with the CPU.

Then, particular processing parameters relating to the desired shape of the finished lens, including the configurations of bevel 22 and step 26, may be selected by the technician and input into edger device 20 via controls 54 at S2. For example, the profile of bevel 22 may be selected by the technician. The position, or front to back placement, of bevel 22 on peripheral edge 14 may be selected by the technician. The placement of step 26 relative to apex 24 and/or interface 18 may be selected by the technician. Additionally, the width W and depth D of step 26 may be selected by the technician.

The width W and depth D of step 26 may vary depending on its position along the entire circumference of lens blank L. For example, the width W of step 26 may be greater in portion of peripheral edge 14 proximate the A-dimension compared to the width W of step 26 in portions of peripheral edge 14 proximate the B-dimension. A wider step 26 across the A-dimension may be desirable for some frames, such as high wrap frames that have more curvature across the A-dimension, and less across the B-dimension. Thus, there may be more need for step 26 at the extreme curvatures of the A-dimension. In addition, lenses are often thicker at their nasal and temporal sides, requiring a shelf having increased width and depth. Moreover, some frames may only require step 26 across the A-dimension, such that no step 26 is formed across the B-dimension.

Therefore, desired processing parameters of bevel 22 and step 26 may be selected by the technician and input into edger device 20 via controls 54. Alternatively, the desired processing parameters of bevel 22 and step 26 may be downloaded to the CPU via an associated serial port, if such information is available.

The CPU then transmits an instruction set for initiating a roughing process at S3. During the roughing process, edger device 20 grinds peripheral edge 14 of lens blank L to a preliminary size and shape using router tool 34 that is slightly larger than the desired size and shape of the finished lens. Edger device 20 preferably grinds peripheral edge 14 using a planar portion of blade 46. Lens blank L is edged to a slightly larger size and shape compared to the desired size and shape of the finished lens during the roughing process because additional lens material will be removed during the beveling process. Thus, lens blank L will be 'roughly' the size and shape of the desired finished lens after the roughing process, with a size and shape sufficiently larger than the desired finished size and shape so that additional lens material may be removed during subsequent processing steps.

The CPU then transmits an instruction set for initiating the beveling process at S4, causing edger device 20 to grind the roughed peripheral edge 14 of lens blank L using router tool 34. As best shown in FIG. 5, router tool 34 engages and edges peripheral edge 14 using blade 36 (or 44 or 46) having cutting portion 38 (or 48 or 50) corresponding to the selected profile of bevel 22. Note that the specific profile of cutting portion 38 shown in FIG. 5 is exemplary only. Router tool 34 forms bevel 22 around the entire peripheral edge 14 at a selected position defined by the selected processing parameters and relative to the trace data. Preferably, edger device 20 includes a probe for measuring the curvature of the lens, which is communicated to the CPU. The shape of lens blank L is known from the trace data. Based upon the known shape and measured curvature of lens blank L, proper formation and positioning of bevel 22 according to the selected parameters is ensured.

Then, an instruction set causes edger device 20 to form step 26 at a predetermined or selected width and depth in peripheral edge 14 of lens blank L at S5. Additional lens blank material is removed using planar cutting portion 42 of second blade 40, as best shown in FIG. 6. The width W and depth D of step 26 defines the position of step 26 on peripheral edge 14. Preferably, step 26 is intermediate apex 24 and interface 18. However, portions of bevel 22 including apex 24 may also be removed in some positions about peripheral edge 14, or about the entire periphery thereof, depending on the selected or downloaded processing parameters.

The configuration and position of step 26 are based upon the selected or downloaded parameters at S2, as well as the recalled trace data at S1. Depending on the selected or downloaded parameters for step 26, a portion of bevel 22 may be removed during formation of step 26, as shown in FIG. 4. Moreover, step 26 may be formed about the entire periphery of lens blank L, or in only selected portions thereof, such as proximate only the A-dimension. For example, the instruction set at S5 may cause edger device 20 to form step 26 only across the A-dimensions.

In addition, the width W and depth D of step 26 may vary about the periphery of lens blank L depending on the selected or downloaded parameters at S2 and recalled trace data at S1. For example, the instruction set at S5 may cause edger device to form step 26 having a first width in portions of peripheral edge 14 proximate the A-dimension, and a having a second width in portions of the peripheral edge 14 proximate the B-dimension. For many high wrap frames, or relatively thick lenses, the first width is preferably greater than the second width, resulting in a more extreme step 26 in the A-dimension.

Figure 9:
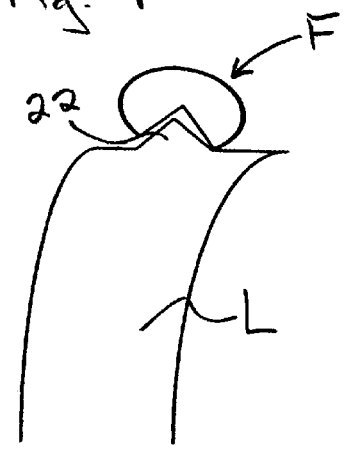
FIG. 9 is a fragmentary sectional view of a ophthalmic lens blank having a bevel, and a cooperating lens mount.
Figure 9A:
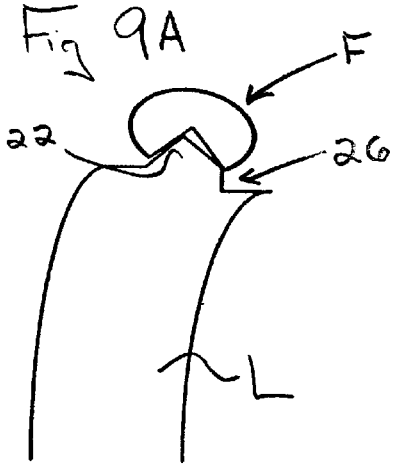
FIG. 9A is a fragmentary sectional view of an ophthalmic lens blank having a bevel and a step, and a cooperating lens mount.

Bevel 22 and step 26 may be formed in the resulting edge blank in a single control step. The resulting step 26 proximate bevel 22 ensures a relatively tight fit between the finished lenses and frame, even with frames having high wrap, or lenses that are relatively thick. A lens formed according to a conventional method includes only a bevel, as shown in FIG. 9. When inserted into a high wrap frame F, bevel 22 fails to fit snugly within the corresponding groove of frame F, particularly across the A-dimension where curvature is the greatest. Formation of step 26 adjacent bevel 22 allows for an improved fit between bevel 22 and the corresponding groove of frame F, even in high wrap frames, as shown in FIG. 9A.

The present invention also relates to a computer program stored on a medium for use in an edging process employing a lens blank and an edger device, such as edger device 20. The computer program includes a first set of computer instructions operably recalling trace data about a lens blank to be processed. A second set of computer instructions operably causes edger device 20 to grind lens blank L to a rough size and shape slightly larger than the desired size and shape of the finished lens. A third set of computer instructions operably causes edger device 20 to form bevel 22 in peripheral edge 14 of the lens blank L at a selected position defined by and relative to the trace data. Preferably, the third set of computer instructions causes edger device 20 to form a bevel having a selected profile. A fourth set of computer instructions operably causes edger device 20 to form step 26 in peripheral edge 14 intermediate apex 24 and interface 18. The fourth set of computer instructions may causes edger device 20 to form step 26 having a first width along a selected portion of peripheral edge 14, and a second width along another selected portion of peripheral edge 14, as described above.

Thus, the disclosed computer program and method allow for a lens blank to be roughed and beveled, and then for the formation of a step on the beveled lens blank, in a single control system, and thus in a single cycle. An edger device controlled by the disclosed software algorithm will first execute a beveling process. Then, the software directs the edger to form a step in the beveled lens edge that corresponds to the selected or downloaded parameters and based upon the trace data for the lens and frame.

An exemplary computer routine for the disclosed computer program is provided in computer program listing Appendix A. However, it would be readily understood that other computer routines may be applied to achieve the disclosed method. Thus, it will be apparent to one of ordinary skill in the art that various modifications and variations can be made to the disclosed invention without departing from the spirit of the invention. Therefore, it is intended that the present invention include all such modifications or variations, provided they come within the scope of the following claims and their equivalents.

I claim:

1. A method of controlling an edger device for edging an ophthalmic lens blank, comprising the steps of:

providing a lens blank having first and second opposite major surfaces, and a peripheral edge therebetween;

providing an edger device having a cutting mechanism for forming a bevel in the peripheral edge;

providing a central processing unit operably associated with the edger device for controlling operation of the cuffing mechanism; and transmitting processing instructions from the central processing unit to the edger device, wherein the processing instructions comprise:

a) forming a bevel in a peripheral edge of a lens blank, the peripheral edge having a portion lying on a first plane and the bevel having an apex extending outwardly from the first plane;

b) forming a step in the peripheral edge intermediate the apex and an interface between the peripheral edge and the second major surface, the step having a base lying on a second plane spaced from and parallel to the first plane.

2. The method of claim 1, including the further step of selecting a position of the bevel prior to said transmitting step.

3. The method of claim 1, including the further step of selecting a profile of the bevel prior to said transmitting step.

4. The method of claim 1, including the further steps of:

recalling trace data about the lens to be processed prior to said transmitting step; and selecting a position in the peripheral edge for forming the bevel, wherein the bevel is formed at the selected position which is relative to and determined by the recalled trace data.

5. The method of claim 1, including the step of removing at least a portion of a sidewall of the bevel during said step of forming a step in the peripheral edge.

6. The method of claim 1, wherein the lens includes an A dimension and a B dimension, the step formed to have a first width proximate the A dimension and a second width proximate the B dimension during said step of forming a step in the peripheral edge.

7. The method of claim 6, wherein the first width is greater than the second width.

8. The method of claim 1, wherein the lens includes an A dimension and a B dimension, the step formed proximate the A dimension during said step of forming a step in the peripheral edge.

9. The method of claim 1, including the further step of roughing the peripheral edge of the lens blank to a first size and shape prior to said step of forming a bevel.

10. The method of claim 1, wherein the processing instructions are transmitted during said transmitting step for processing the lens blank in a single control cycle.

11. A machine programmed to edge a lens blank, comprising:

an edger device for forming a bevel in a peripheral edge of a lens blank;

a central processing unit operably associated with the edger device for controlling operation of the edger device; and a computer program stored on a medium in communication with said central processing unit, said computer program comprising:

a) a first instruction set operably causing said edger device to form a bevel in a peripheral edge of a lens blank, the peripheral edge having a portion lying on a first plane and the bevel having an apex extending outwardly from the first plane; and b) a second instruction set operably causing said edger device to form a step in the peripheral edge intermediate the apex and an interface between the peripheral edge and a major surface of the lens blank, the step having a base lying on a second plane spaced from and parallel to the first plane.

12. The machine of claim 11 wherein said edger device includes a router tool having a first blade having a profiled cutting portion for forming the bevel and a second blade having a planar cutting portion for forming the step.

13. The machine of claim 11 wherein said edger device includes a router tool having a blade, said blade having a profiled cutting portion for forming the bevel and a planar cuffing portion for forming the step.

14. The machine of claim 11 further comprising trace data stored on the medium and in communication with said central processing unit, said trace data defining a shape of the peripheral edge of the lens blank, said first instruction set operably causing said edger device to form the bevel at a selected position defined by and relative to the trace data.

15. The machine of claim 14 further comprising an input device operably associated with said central processing unit, wherein said selected position is input via said input device.

16. The machine of claim 11 wherein the lens includes an A dimension and a B dimension, and said second instruction set operably causes said edger device to form a step having a first width proximate the A dimension and a second width proximate the B dimension.

17. The machine of claim 16, wherein said first width is greater than said second width.

18. The machine of claim 11, wherein the lens includes an A dimension and a B dimension, and said second instruction set operably causes said edger device to form the step proximate the A dimension.

19. The machine of claim 11, wherein said first and second instruction sets of said computer program operably cause said edger device to form said bevel and said step in a single control cycle.

20. A computer program stored on a medium for use in an edging process employing a lens blank and an edger device, the computer program comprising:

a first set of computer instructions operably recalling trace data about a lens blank to be processed, the lens blank having first and second opposite major surfaces and a peripheral edge therebetween;

a second set of computer instructions operably causing an edger device to form a bevel in the peripheral edge of the lens blank at a selected position defined by and relative to the trace data, the peripheral edge having a portion lying on a first plane and the bevel having an apex extending outwardly from the first plane; and a third set of computer instructions operably causing the edger device to form a step in the peripheral edge intermediate the apex and an interface between the peripheral edge and the second major surface, the step having a base lying on a second plane spaced from and parallel to the first plane.

21. The computer program of claim 20, wherein said second set of computer instructions operably causes the edger device to form a bevel having a selected profile.

22. The computer program of claim 20 wherein said third set of computer instructions operably causes the edger device to form the step along a first portion of the peripheral edge.

23. The computer program of claim 22 wherein said third set of computer instructions operably causes the edger device to form a step having a first width along the first portion and a second width along a second portion of the peripheral edge.

24. The computer program of claim 20 wherein the second and third sets of computer instructions operably cause the edger device to form the bevel and the step in a single control cycle.

* * * * *